US005371507A

United States Patent [19]

Kuroda et al.

[11] Patent Number: 5,371,507

[45] Date of Patent: Dec. 6, 1994

[54] PLANAR ANTENNA WITH RING-SHAPED RADIATION ELEMENT OF HIGH RING RATIO

[75] Inventors: Shinichi Kuroda, Saitama; Noboru Ono, Tokyo; Ichiro Toriyama, Kanagawa, all of Japan

[73] Assignee: Sony Corporation, Tokyo, Japan

[21] Appl. No.: 114,977

[22] Filed: Aug. 31, 1993

Related U.S. Application Data

[63] Continuation of Ser. No. 875,643, Apr. 29, 1992, abandoned.

[30] Foreign Application Priority Data

May 14, 1991 [JP] Japan ..... 3-109333
May 15, 1991 [JP] Japan ..... 3-110435

[51] Int. Cl.[5] ..... H01Q 1/38; H01Q 13/10

[52] U.S. Cl. ..... 343/700 MS; 343/767; 343/846

[58] Field of Search ..... 343/700 MS, 769, 767, 343/830, 829, 846, 852, 860, 831, 845; H01Q 1/38, 13/10

[56] References Cited

U.S. PATENT DOCUMENTS 4,060,810 11/1977 Kerr et al. ..... 343/700 MS
4,827,271 5/1989 Berneking et al. ..... 343/700 MS
4,987,421 1/1991 Sunahara et al. ..... 343/700 MS
5,055,852 10/1991 Dusseux et al. ..... 343/725
5,233,360 8/1993 Kuroda et al. ..... 343/700 MS

FOREIGN PATENT DOCUMENTS 0403910 12/1990 European Pat. Off. ..... H01Q 5/01

OTHER PUBLICATIONS

IEEE Transactions on Antennas and Propagation, vol. 31, No. 6, Nov. 1983, New York, US, pp. 949–955, Sharma et al. 'Analysis and Optimized Design of Single Feed Circularly Polarized Microstrip Antennas', p. 950.

IEEE Transactions on Antennas and Propagation, vol. 34, No. 11, Nov. 1986, New York, US, pp. 1340–1346, Palanisamy et al. 'Analysis of Circularly Polarized Square Ring and Crossed-Strip Microstrip Antennas', pp. 1340–1343; figures 1–6.

*Primary Examiner*—Donald Hajec
*Assistant Examiner*—Hoanganh Le
*Attorney, Agent, or Firm*—Jay H. Maioli

[57] ABSTRACT

A planar antenna comprised of a ground conductor, a dielectric layer laminated on the ground conductor, and a rectangular radiation element laminated on the dielectric layer on its surface opposing to the ground conductor, wherein a rectangular opening is concentrically formed through the radiation element so as to provide a ring radiation element and a feed point is disposed near a center of one side of the opening.

7 Claims, 13 Drawing Sheets

PLANAR ANTENNA WITH RING-SHAPED RADIATION ELEMENT OF HIGH RING RATIO

This is a continuation of application Ser. No. 07/875,643 filed Apr. 29, 1992, now abandoned.

BACKGROUND OF THE INVENTION

1. Field of the Invention

The present invention relates generally to planar antennas and, more particularly to a small planar antenna which can be suitably and unitarily formed with mobile communication equipment or the like.

2. Description of the Prior Art

Simplified and miniaturized planar antennas of low profile are generally utilized as an antenna system in the fields of satellite communication and mobile communication.

A microstrip antenna, which is one of the most typical planar antennas, generally utilizes circular or rectangular radiation elements.

The dimension of the radiation elements of these configurations is uniquely determined in response to the frequency used.

In the satellite communication and mobile communication fields, it is a fundamental request that the antennas are miniaturized. Therefore, when the planar antenna is unitarily formed with a high frequency circuit or when the whole communication equipment including the antenna system is unitarily formed as one unit, the rectangular radiation element having an excellent space factor is well matched with the high frequency circuit, the communication equipment or the like as compared with the circular radiation element.

Further, in the above-mentioned communication field, circularly-polarized waves are frequently utilized. To this end, in the conventional planar antennas, as shown in FIGS. 1 to 3, rectangular radiation elements are deformed in a predetermined deformation manner such as cut-away, extension, increase of width or the like in order to effect degeneration and separation. Also, a single feed point is disposed at a proper position on these radiation elements as shown in FIGS. 1 through 3.

As shown in FIG. 1 of the accompanying drawings, a pair of recesses 1C are formed on both ends of one diagonal line of a rectangular radiation element 1 and a single feed point 2 is disposed on the radiation element 1 at the position properly offset from the center of the radiation element 1 parallel to one side, whereby the radiation element 1 is driven in two modes perpendicular to each other along the two diagonal lines as shown by arrows 3*a* and 3*b* in FIG. 1.

These two modes are considered as synthesized modes of $TM_{10}$ and $TM_{01}$. However, if the recesses 1C are not formed on the radiation element 1 as shown by broken lines in FIG. 1, then two modes 3*a*, 3*b* are resonated at the same frequency and cannot be discriminated from each other from the outside, which state will be referred to as degeneration.

If the pair of recesses 1*c* are formed and perturbed as shown in FIG. 1, then the portions of the recesses 1*c* act as a strong electric field area for one mode 3*a* and also act as a strong magnetic field area for the other mode 3*b* so that the amounts in which resonant frequencies of the respective modes 3*a*, 3*b* are displaced by the existence of the recesses 1*c* become different. As a consequence, the two modes 3*a* and 3*b* are resonated at different frequencies and released (separated) from the degenerated state. Therefore, the two modes can be discriminated from each other from the outside.

As described above, the planar antenna having the rectangular radiation element shown in FIG. 1 can generate a circularly-polarized wave by the single feed point 2 by applying the perturbation to the recesses 1*c* so as to make the exciting phase difference become 90 degrees.

Further, in a rectangular radiation element 1S shown in FIG. 2, the recesses 1*c* of FIG. 1 are replaced with stubs 1*b* and a circularly-polarized wave can be generated by the single feed point 2 similarly as described above.

Furthermore, in a rectangular radiation element 1W of FIG. 3, a width l thereof is increased by a proper amount ($2\cdot\Delta l$) and a single feed point 2 is disposed on one diagonal line of the radiation element 1W at the position properly offset from the center of the radiation element 1W, whereby the radiation element 1W is driven in two orthogonal modes parallel to the respective sides as shown by arrows 3*a* and 3*b*.

The radiation element 1W shown in FIG. 3 is perturbed at the extended width portion 1*sp* so as to provide an exciting phase difference of 90 degrees, thereby making it possible to generate a circularly-polarized wave by the single feed point 2.

In any of the above-mentioned three examples, a relation is established between an area S of an original rectangular radiation element and an area ΔS of a degenerated or separated portion (recess, stub, widened portion) as expressed by the following equation (1):

$$\Delta S/S = \tfrac{1}{2}\cdot Qo \qquad (1)$$

where Qo is the no-load Q of the planar antenna.

When the planar antenna itself is miniaturized, such a method is known to reduce the dimension of the radiation element by changing a ratio between sides so that a length thereof in the direction perpendicular to the exciting direction 3 defined by the position of the feed point 2 is reduced, that is, the rectangular radiation element 1 shown in FIG. 4A is reduced to a radiation element 1*m* shown in FIG. 4B.

Further, according to the following known method, the dimension of the radiation element is reduced by short-circuiting the radiation element 1 to a ground conductor 5 at a zero potential line 4 passing the center of the original radiation element 1 and which is perpendicular to the excitation direction 3 as if the rectangular radiation element 1 shown in FIG. 5A is reduced to a radiation element 1*h* shown in FIGS. 5B and 5C.

However, in the conventional miniaturized planar antennas shown in FIGS. 4 and 5, the lengths of the radiation element in the excitation direction and lengths perpendicular to the excitation directions are very different from each other, that is, a so-called isotropic property of the radiation element is deteriorated. As a consequence, independent orthogonal modes cannot be realized at substantially equal resonance frequencies and therefore circularly-polarized waves cannot be generated. For this reason, the conventional planar antenna cannot be utilized in fields of circularly-polarized wave communication such as a mobile communication or the like.

OBJECTS AND SUMMARY OF THE INVENTION

Therefore, it is an object of the present invention to provide an improved planar antenna in which the aforesaid shortcomings and disadvantages encountered with the prior art can be eliminated.

More specifically, it is an object of the present invention to provide a planar antenna which can be miniaturized.

Another object of the present invention is to provide a planar antenna which is excellent in space factor.

Still another object of the present invention is to provide a planar antenna which can be well matched with a high frequency circuit, communication equipment or the like.

A further object of the present invention is to provide a planar antenna which can generate circularly-polarized waves by a proper excitation.

A still further object of the present invention is to provide a planar antenna which can generate circularly-polarized waves by a single feed point.

As a first aspect of the present invention, a planar antenna is comprised of a ground conductor, a dielectric layer laminated on the ground conductor, and a rectangular radiation element laminated on the dielectric layer on its surface opposing to the ground conductor, wherein a rectangular opening is concentrically formed through the radiation element so as to provide a ring radiation element and a feed point is disposed near a center of one side of the opening.

In accordance with a second aspect of the present invention, a planar antenna is comprised of a ground conductor, a dielectric layer laminated on the ground conductor, and a rectangular radiation element laminated on the dielectric layer on its surface opposing to the ground conductor and which is deformed in a predetermined manner so as to effect degeneration and separation, wherein a rectangular opening is concentrically formed through the radiation element so as to provide a ring radiation element and a single feed point is disposed near the center of one side of the opening.

Furthermore, according to the planar antenna of the present invention, circularly-polarized waves can be generated by the single feed point.

The above and other objects, features, and advantages of the present invention will become apparent from the following detailed description of illustrative embodiments thereof to be read in conjunction with the accompanying drawings, in which like reference numerals are used to identify the same or similar parts in the several views.

DETAILED DESCRIPTION OF THE PREFERRED EMBODIMENTS

Figure 1:
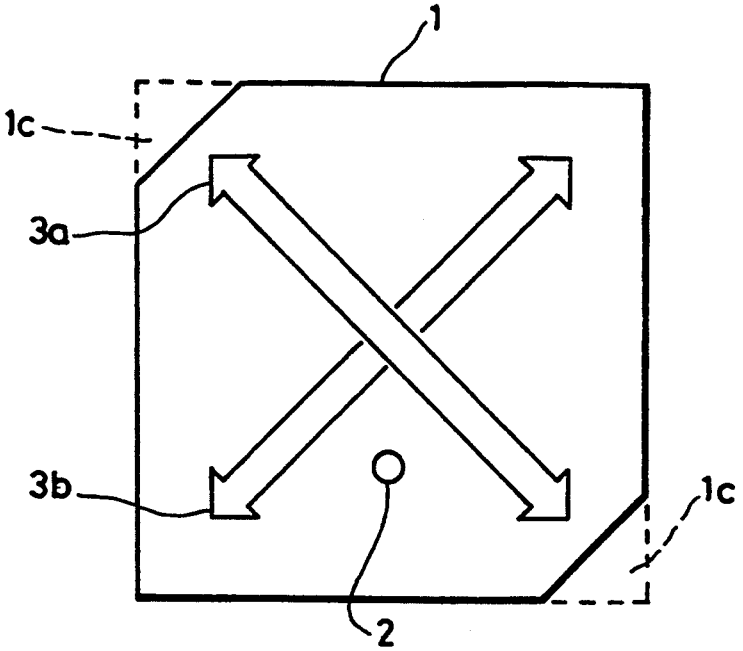
FIG. 1 (PRIOR ART)
FIG. 1 is a plan view illustrating a first example of an arrangement of a main portion of a planar antenna according to the prior art.
Figure 2:
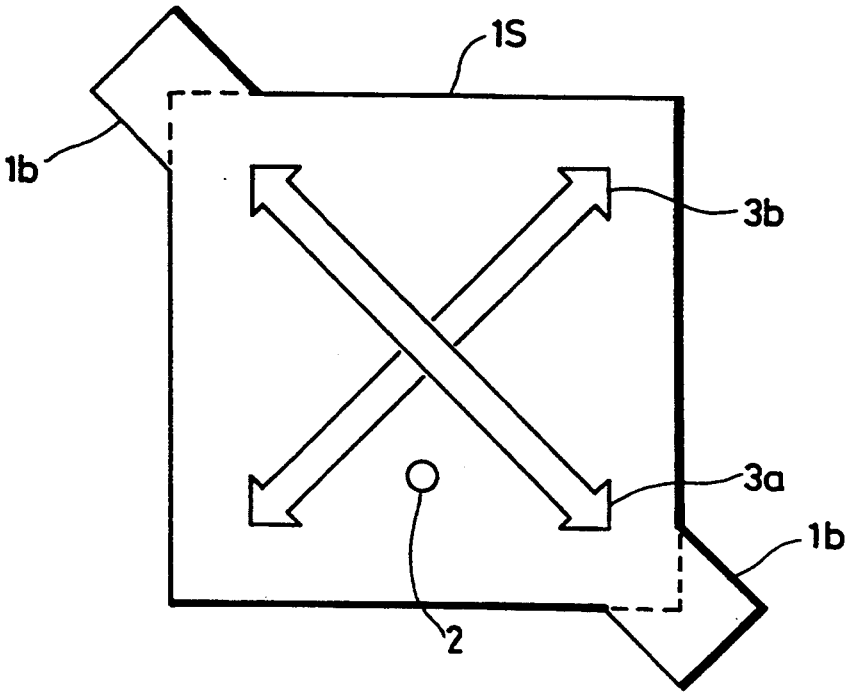
FIG. 2 (PRIOR ART)
FIG. 2 is a plan view illustrating a second example of an arrangement of a main portion of a planar antenna according to the prior art.
Figure 3:
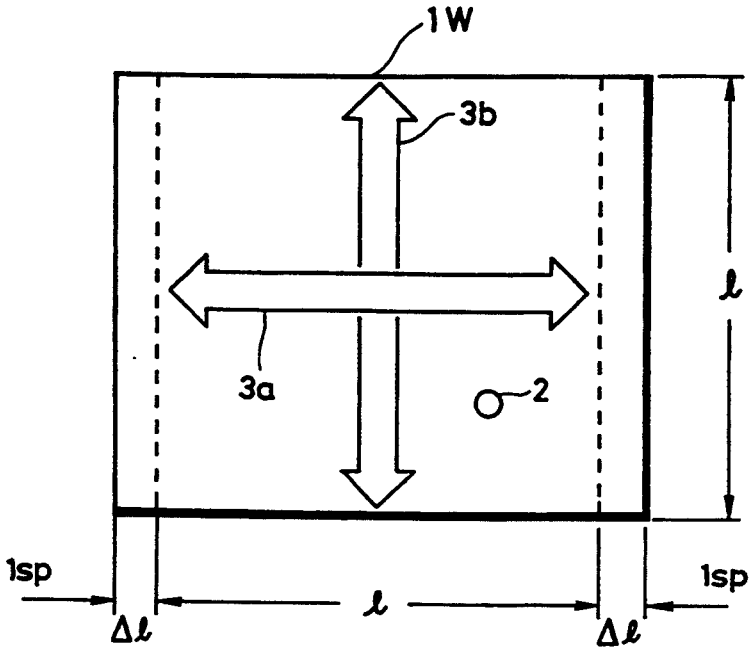
FIG. 3 (PRIOR ART)
FIG. 3 is a plan view illustrating a third example of an arrangement of a main portion of a planar antenna according to the prior art.

The present invention will now be described with reference to the drawings.

An arrangement of a first embodiment according to the present invention will be described with reference to FIGS. 6 to 8.

In FIGS. 6 through 9 of the accompanying drawings, reference numeral 10 generally depicts a planar antenna in which a rectangular radiation element 13 is concentrically laminated on a rectangular ground conductor 11 via a dielectric layer 12 of low dielectric loss made of a fluorine resin or the like and a rectangular opening 14 is concentrically formed through the radiation element 13 so as to be ring-shaped. A feed point 15 is disposed in the vicinity of the center of one side 14*s* of the rectangular opening 14.

Figure 7:
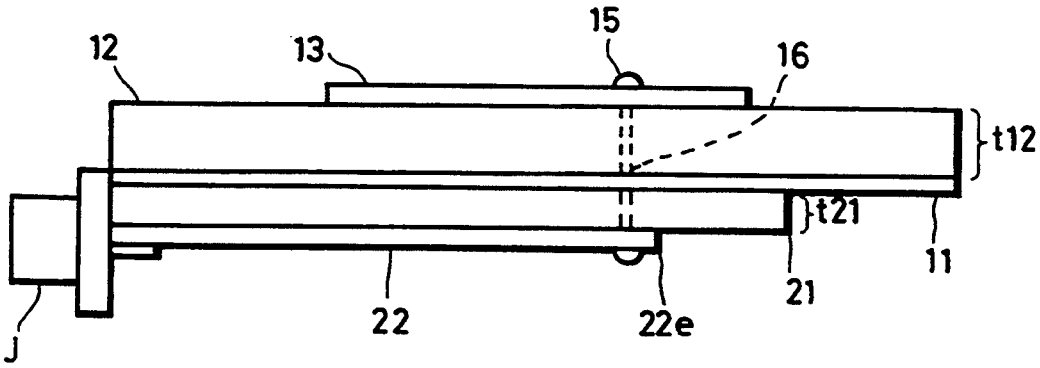
FIG. 7 is a side view illustrating the arrangement of the first embodiment according to the present invention.
Figure 8:
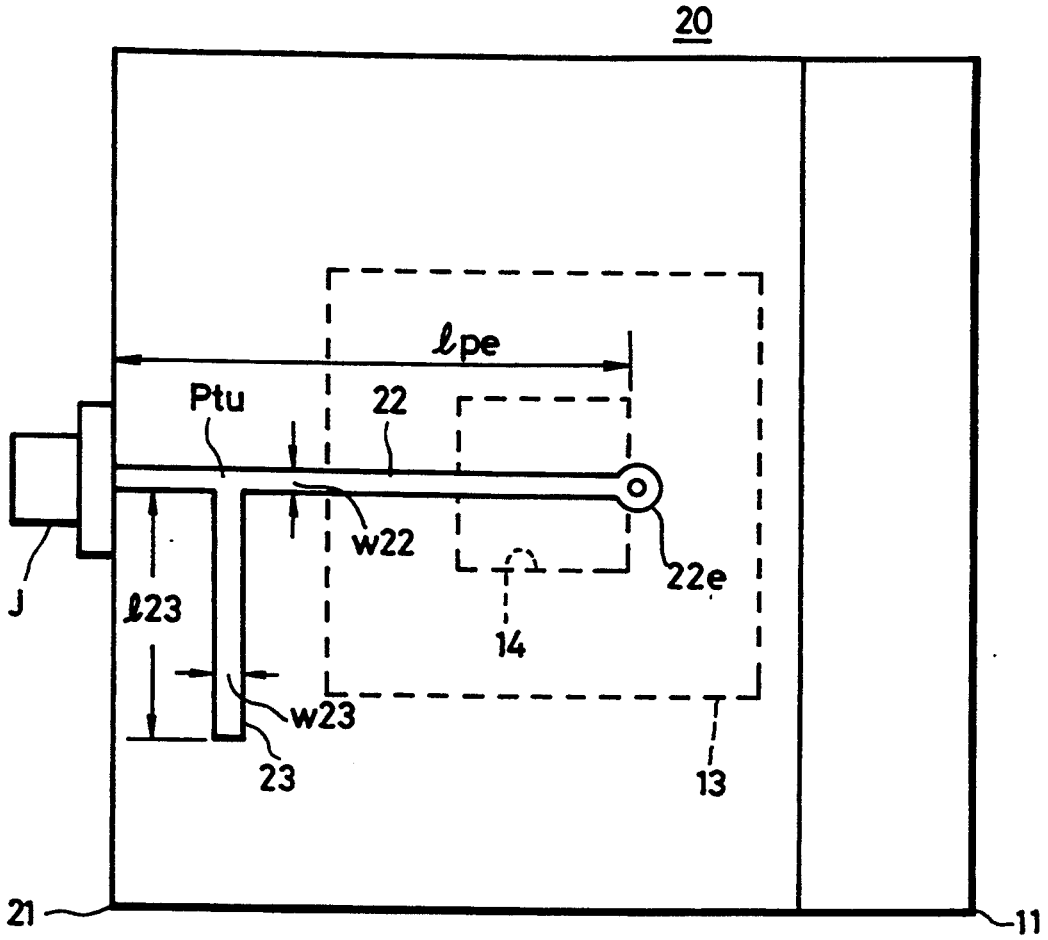
FIG. 8 is a bottom view illustrating an arrangement of the planar antenna according to the first embodiment of the present invention.

According to the first embodiment, as shown in FIG. 7, a conductor narrow strip (feed line) 22 or the like is disposed on the ground conductor 11 on its side opposite to the radiation element 13 by means of a dielectric layer 21 of low dielectric loss, thereby a feed system 20 of a microstrip type being constructed as shown in FIG. 8.

A terminal 22*e* of the feed line 22 and the feed point 15 of the radiation element 13 are coupled by a through-hole 16 and coupled through a coaxial connector J to a signal source, not shown.

As shown in FIG. 8, a tuning stub 23 is coupled to the feed line 22 of the feed system 20 at its proper intermediate point Ptu.

When the planar antenna 10 according to the first embodiment is utilized in the 3 GHz band, for example, a width D of the ground conductor 11, a width Ar of the radiation element 13, the size Br of the rectangular opening 14, a thickness t12 of the dielectric layer 12 and a specific inductive capacity $\epsilon r$ of the dielectric layer 12 are respectively set as follows:

D=80 mm, Ar=23.8 mm, Br=11.5 mm, t12=1.6 mm and $\epsilon r$=2.6.

Further, a conductor width w22 of the feed line 22 of the feed system 20, a conductor width w23 of the tuning stub 23, a thickness t21 of the dielectric layer 21, a length l23 of the tuning stub 23, and a length 1 pe of the feed line 22 are respectively set so as to provide a characteristic impedance of 50 Ωas:

w22=w23=2.2 mm, t21=0.8 mm l23=13.2 mm, lpe=18.0 mm

Operation of the first embodiment according to the first embodiment will be described with reference to also FIGS. 9 and 10.

Figure 4A:
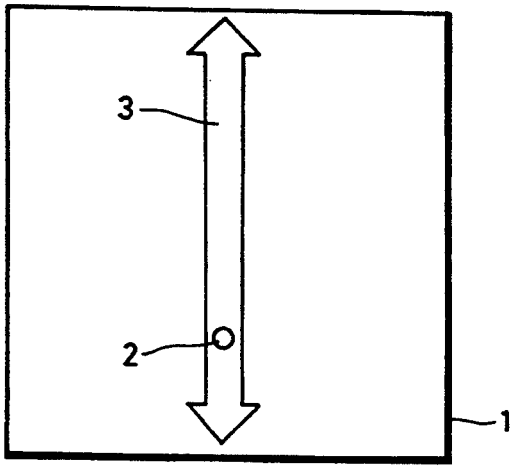
FIG. 4A (PRIOR ART)
FIGS. 4A and 4B are respectively plan views illustrating a fourth example of a main portion of a planar antenna according to the prior art.
Figure 4B:
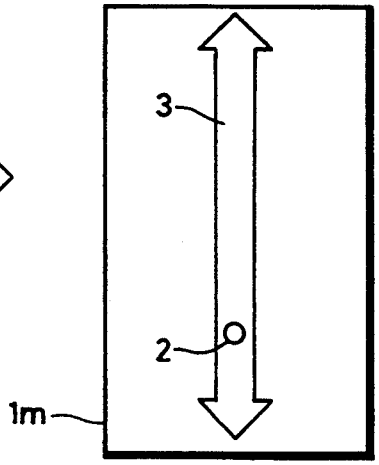
FIG. 4B (PRIOR ART)
Figure 5A:
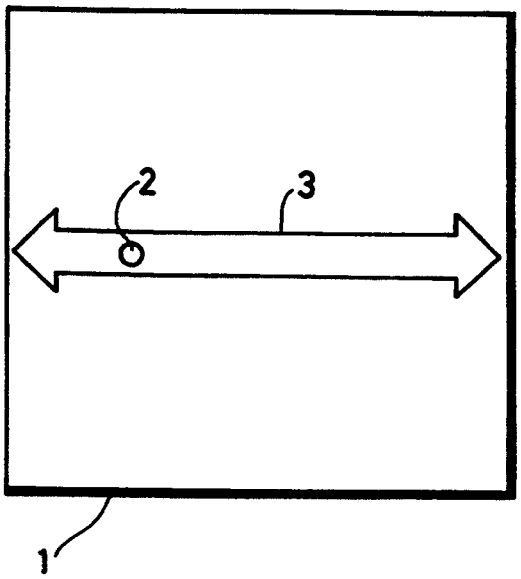
FIG. 5A (PRIOR ART)
FIGS. 5A and 5B are respectively plan views illustrating a fifth example of a main portion of a planar antenna according to the prior art.
Figure 5B:
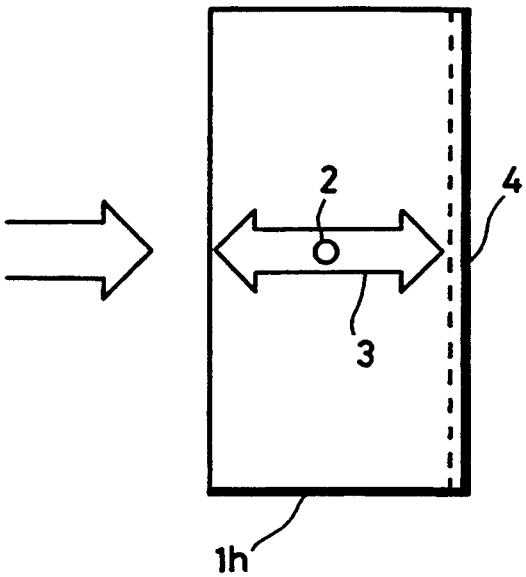
FIG. 5B (PRIOR ART)
Figure 5C:
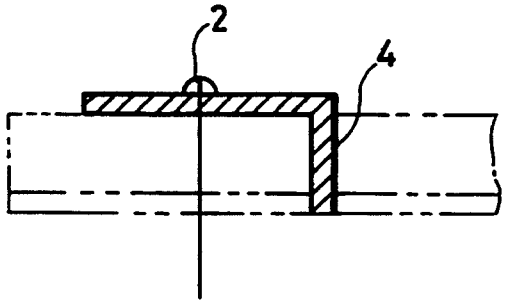
FIG. 5C (PRIOR ART)
FIG. 5C is a cross-sectional side view of FIG. 5B.

In the case of the rectangular radiation element shown in FIG. 4A, a relation expressed in the following equation (2) is established between the side length Ar and the resonant frequency f in the main mode ($TM_{10}$):

$$Ar = \frac{xc}{2\pi f\sqrt{\epsilon r}} - \frac{4t \cdot \ln 2}{\pi} \quad (2)$$

In the equation (1), c is the speed of light, t is the thickness of the dielectric and $\epsilon r$ is the specific inductive capacity of the dielectric.

Further, x in the above equation (2) represents a value inherent in the shape of the radiation element. The value x is generally given by solving a secondary wave equation derived from Maxwell's equation. In the case of the rectangular radiation element shown in FIG. 4A, the value x is expressed as:

$$x = \pi \quad (3)$$

When the planar antenna 10 is formed as an annular shape in which the rectangular opening 14 is concentrically formed through the rectangular radiation element 13 as described in the first embodiment, it is difficult to obtain the inherent value x in the aforementioned equation (2) analytically. However, the inventors of the present invention have experimentally confirmed the inherent value x of the rectangular annular radiation element becomes smaller as compared with that of the rectangular radiation element.

Figure 9:
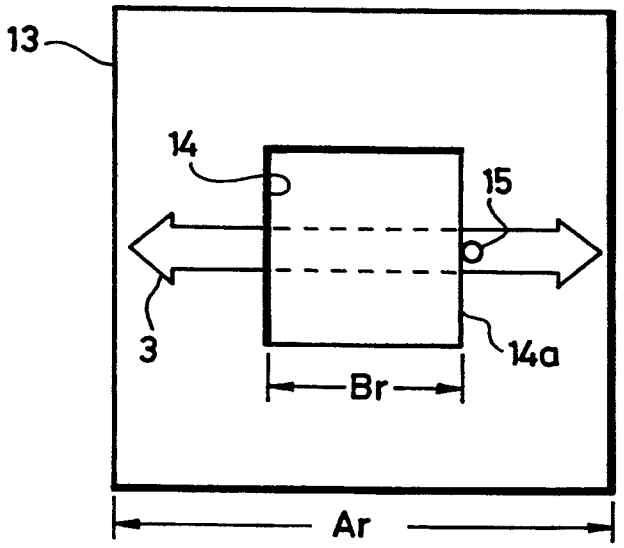
FIG. 9 is a schematic diagram used to explain operation of the first embodiment of the present invention.
Figure 10:
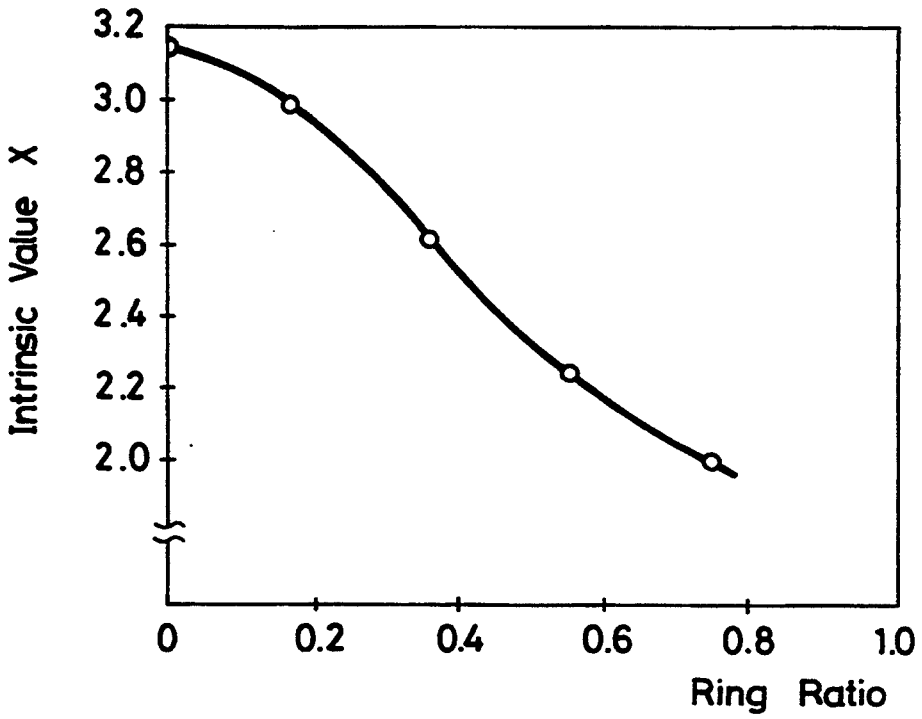
FIG. 10 is a graph used to explain operation of the first embodiment of the present invention.

When the radiation element is formed as an annular shape such that the rectangular opening 14 having a side length Br is formed through the rectangular radiation element 13 having a side length Ar as shown in FIG. 9, as an equivalent side length Beq of the opening 14 becomes closer to an equivalent side length Aeq of the radiation element 13, or an inner and outer side length ratio Beq/Aeq (ring ratio) of the rectangular ring becomes closer to 1, the value of the inherent value x is reduced as shown in FIG. 10.

The equivalent side lengths Aeq and Beq correspond to magnetic current loops which are theoretically assumed in consideration of a fringe effect and therefore expressed as in the following equations (4) and (5):

$$Aeq = Ar + \frac{4t \cdot \ln 2}{\pi} \quad (4)$$

$$Beq = Br - \frac{4t \cdot \ln 2}{\pi} \quad (5)$$

When the conventional planar antenna having a dielectric layer which is the same as that of the aforementioned embodiment in quality and in thickness and a ring ratio of 0 is similarly utilized in the 3 GHz band, then the side length Ar of the radiation element is expressed as follows:

$$Ar = 29.6 \text{ mm} \quad (6)$$

This value of the side length Ar is larger than the aforesaid side length of the rectangular ring radiation element according to the above-mentioned embodiment by about 24%. In the conventional planar antenna, the sizes of the ground conductor and the dielectric layer are increased with substantially the same percentage.

Figure 11:
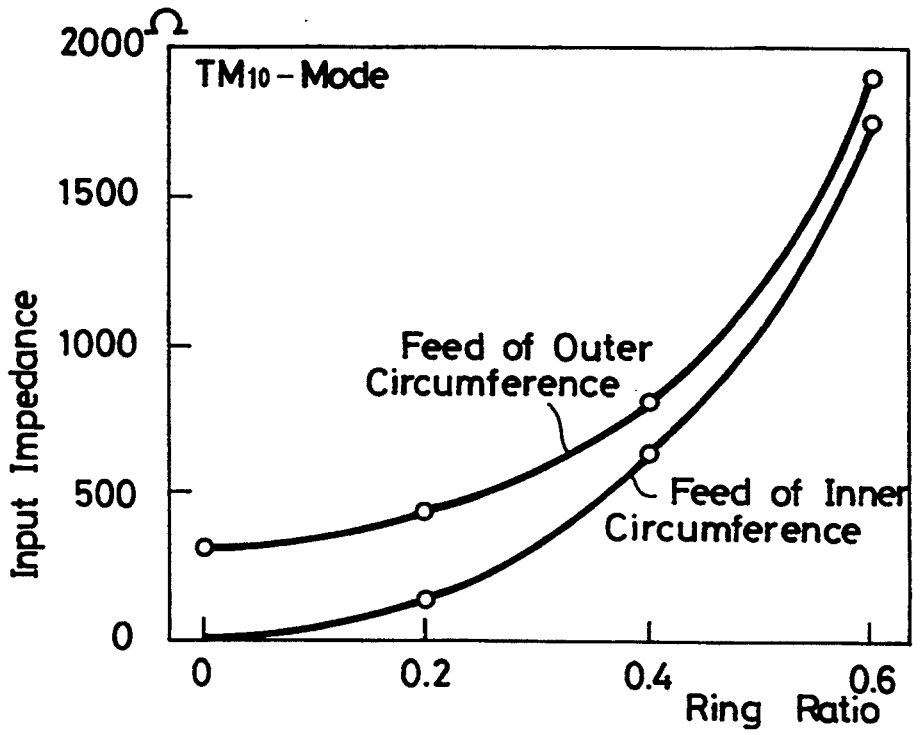
FIG. 11 is a graph showing characteristics, i.e., ring ratio versus input impedance of the first embodiment of the present invention.
Figure 12:
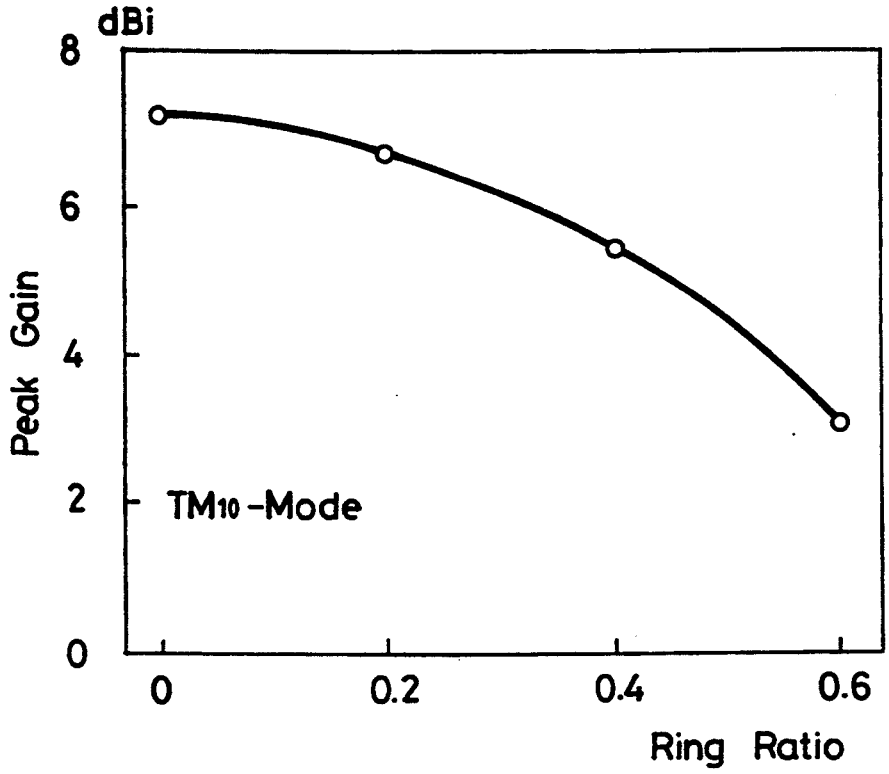
FIG. 12 is a graph showing characteristics, i.e., ring ratio versus peak gain of the first embodiment of the present invention.

According to the first embodiment, the value of the intrinsic value x is reduced as the ring ratio (Beq/Aeq) becomes closer to 1 as described before. If the ring ratio (Beq/Aeq) becomes closer to 1, even when the planar antenna is operated by the voltage supplied to the inner circumference thereof, the input impedance of the antenna is increased as shown in FIG. 11 and its peak gain is lowered as shown in FIG. 12.

As a result, the ring ratio is limited as in the following equation in actual practice:

$$0.6 \geqq Beq/Aeq \quad (7)$$

It is considered that the peak gain is lowered because the loss in the matching circuit is increased.

Figure 13:
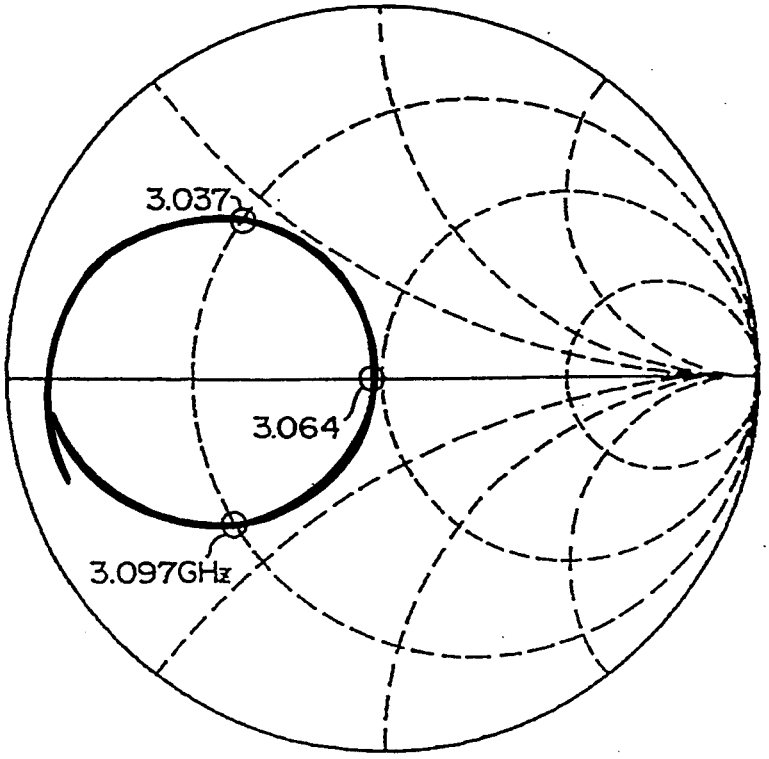
FIG. 13 is a Smith chart of characteristics of the first embodiment of the present invention.
Figure 14:
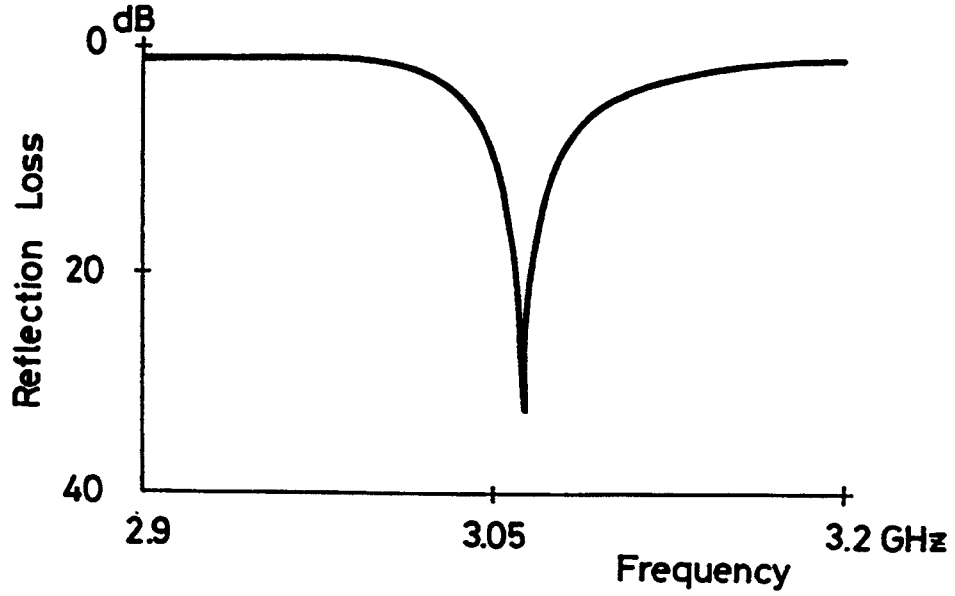
FIG. 14 is a graph showing characteristics, i.e., frequency versus reflection loss of the first embodiment of the present invention.

In the planar antenna according to the first embodiment, in case the ring ratio is 0.4, for example, an impedance versus frequency characteristic is represented in a Smith chart forming FIG. 13, and a reflection loss versus frequency characteristic shown in FIG. 14 is obtained.

Figure 15:
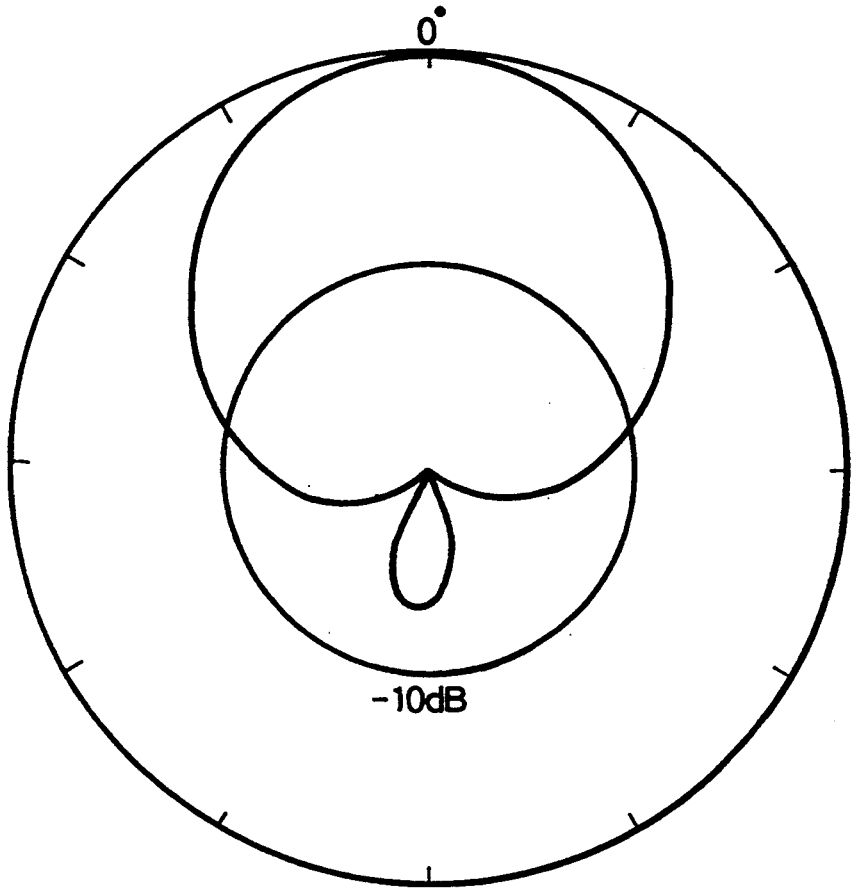
FIG. 15 is a schematic diagram showing radiation characteristics of the first embodiment of the present invention.

Further, a radiation characteristic on an E plane, for example, is represented in FIG. 15 and a radiation characteristic on an H plane becomes substantially similar to that of FIG. 15.

According to the first embodiment, since the rectangular opening 14 is concentrically formed through the rectangular radiation element 13 so as to provide the ring-shaped planar antenna and the feed point is disposed in the vicinity of the center of one side of this rectangular opening 14, the planar antenna can be miniaturized more while the isotropic property of the radiation element, excellent space factor and adaptability with communication equipment or the like can be maintained.

Figure 16:
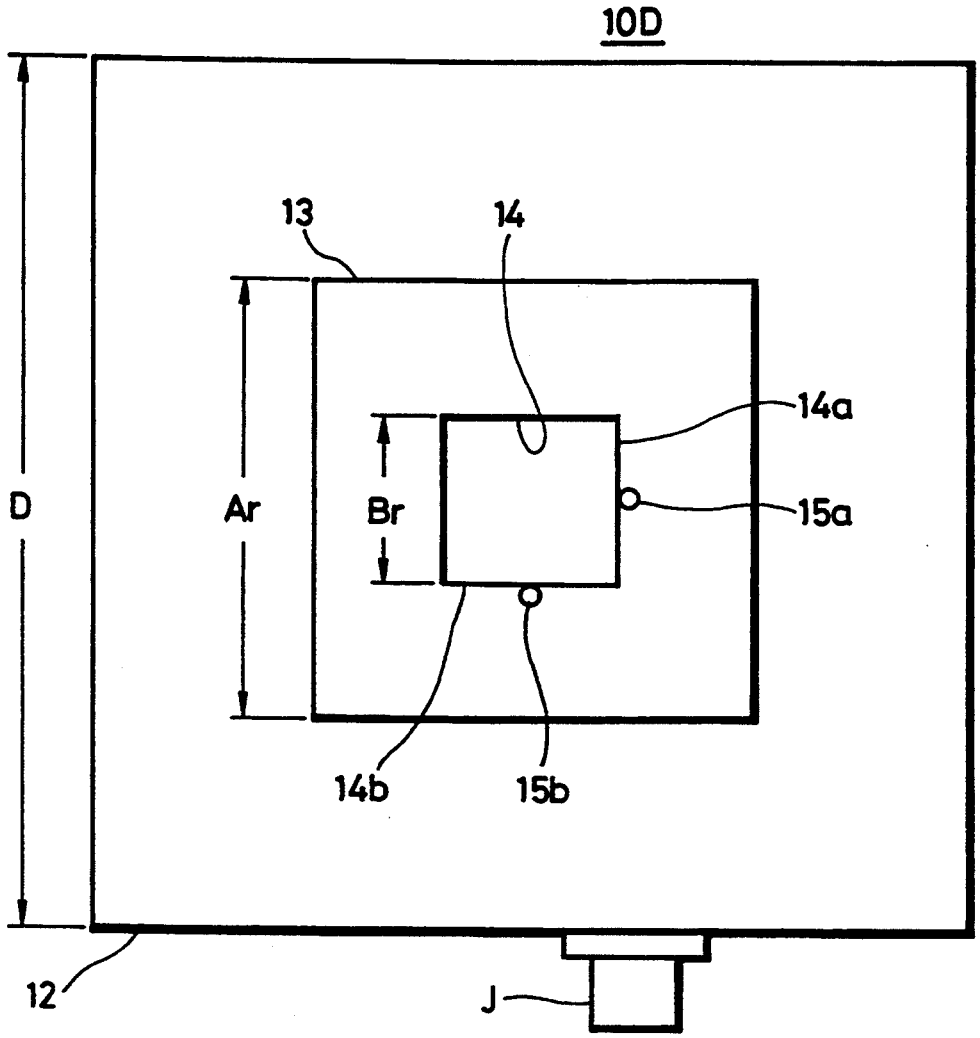
FIG. 16 is a plan view illustrating a planar antenna according to a second embodiment of the present invention.
Figure 17:
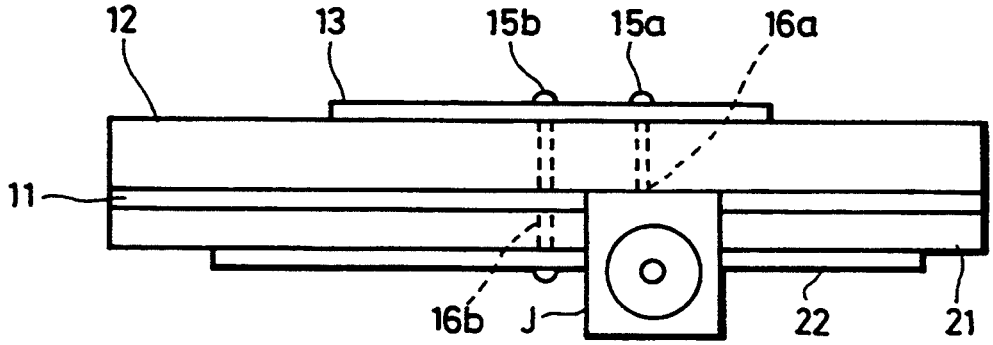
FIG. 17 is a side view illustrating the planar antenna according to the second embodiment of the present invention.
Figure 18:
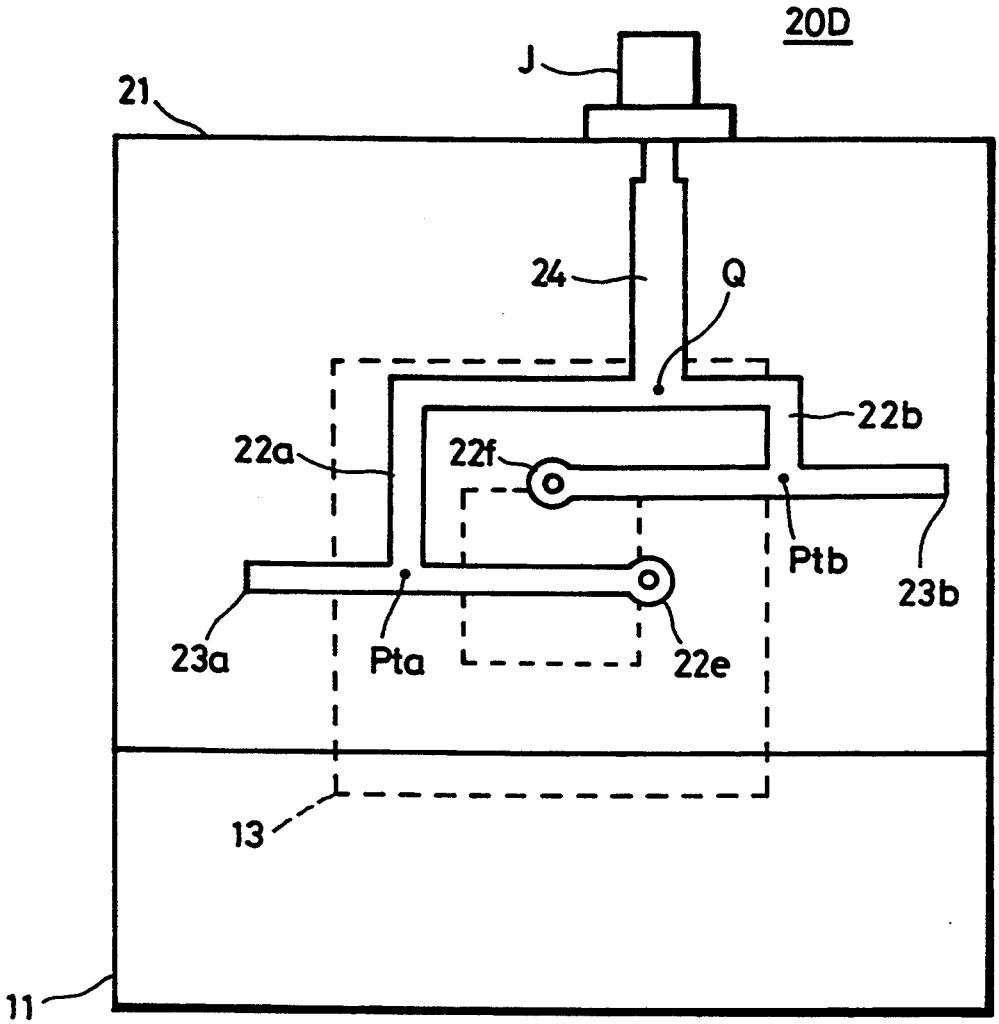
FIG. 18 is a bottom view illustrating the planar antenna according to the second embodiment of the present invention.

A second embodiment of the present invention will be described below with reference to FIGS. 16 to 18. In FIGS. 16 through 18, like parts corresponding to those of FIGS. 6 to 8 are marked with the same references and therefore need not be described in detail.

In FIG. 16, reference numeral 10D generally designates a second embodiment of the planar antenna, the rectangular radiation element 13 is concentrically laminated on the rectangular ground conductor 11 via the dielectric layer 12 of low loss and the rectangular opening 14 is concentrically formed through the radiation element 13, thereby the ring-shaped radiation element 13 being formed.

In the second embodiment, feed points 15*a*, 15*b* are respectively disposed near the centers of two adjacent sides 14*a*, 14*b* of the opening 14.

Further, in the second embodiment, as shown in FIG. 17, a feed line 22 or the like is disposed on the ground conductor 11 on its side opposite to the radiation element 13 through a dielectric layer 21 of low loss and hence a feed system 20D of microstrip type is formed as shown in FIG. 18.

The feed line 22 and the feed points 15*a*, 15*b* of the radiation element 13 are coupled via through-holes 16*a*, 16*b*.

As shown in FIG. 18, the feed lines 22*a*, 22*b* of the feed system 20D are extended from terminals 22*e*, 22*f* corresponding to the feed points 15*a*, 15*b* of the radiation element 13 to a junction Q and the lengths thereof are set to be different by a length of ¼ (λ/4) of radio waves used so that the feed points 15*a*, 15*b* are powered with a phase difference of 90 degrees.

Tuning stubs 23*a*, 23*b* are coupled to proper intermediate points Pta, Ptb of the two feed lines 23*a*, 23*b* and the junction Q is coupled through a λ/4 matching device 24 to the coaxial connector J.

When the planar antenna 10D of the second embodiment is utilized in the 3 GHz band, for example, the dimensions of the ground conductor 11, the radiation element 13, the rectangular opening 14 and so on are set similar to those of the first embodiment.

Further, the dimensions of the feed lines 22*a*, 22*b* of the feed system 20D, its tuning stubs 23*a*, 23*b*, its matching device 24 and the thickness of the dielectric layer 21, etc., are set as follows:

w22=w23=2.2 mm, w24=4.1 mm, t21=0.8 mm
l22*a*=50.9 mm, l22*b*=35.4 mm, lpe=lpf=18.0 mm
l23=13.2 mm, l24=15.5 mm Operation of the second embodiment according to the present invention will be described next with reference to also FIG. 19.

Figure 19:
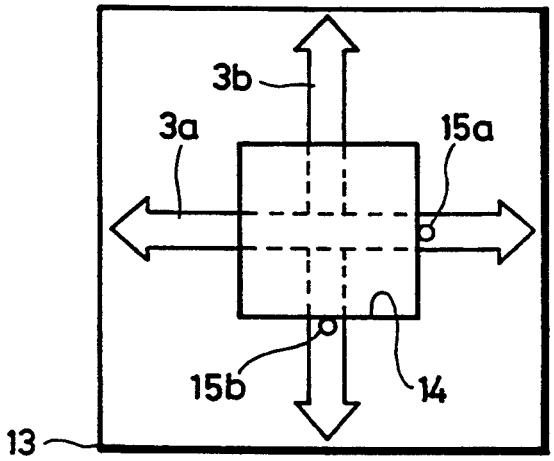
FIG. 19 is a schematic diagram used to explain operation of the second embodiment of the planar antenna according to the present invention.

Also in the second embodiment, since the radiation element 13 is shaped as a rectangular ring so as to maintain its isotropic property, the orthogonal excitation by the feed points 15*a*, 15*b* becomes possible as shown by arrows 3*a*, 3*b* in FIG. 19.

Accordingly, when these feed points 15*a*, 15*b* are powered with the phase difference of 90 degrees by the aforesaid feed system 20D, this planar antenna can generate circularly-polarized waves.

Furthermore, similar to the first embodiment, according to the second embodiment, since the radiation element is shaped as the rectangular ring, the dimension of this radiation element relative to the same resonance frequency can be reduced in response to the ring ratio thereof.

In the second embodiment, characteristics substantially equal to those of FIGS. 13 to 15 can be obtained.

According to this embodiment, since the rectangular opening is concentrically formed through the rectangular element so as to provide a ring-shaped radiation element and the feed points are disposed near the centers of the adjacent two sides of this opening so as to supply the voltage with a predetermined phase difference, the planar antenna can generate circularly-polarized waves while the isotropic property of the radiation element, the excellent space factor and the matching property with the communication equipment and so on are maintained.

As described above in detail, according to the second embodiment of the present invention, since the rectangular opening is concentrically formed through the rectangular element so as to provide a ring-shaped radiation element and the feed points are disposed near the centers of the adjacent two sides of this opening so as to supply the voltage with a predetermined phase difference, the planar antenna can be miniaturized more and also can generate circularly-polarized waves by a proper excitation while the isotropic property of the radiation element and the satisfactory space factor are maintained.

Figure 20:
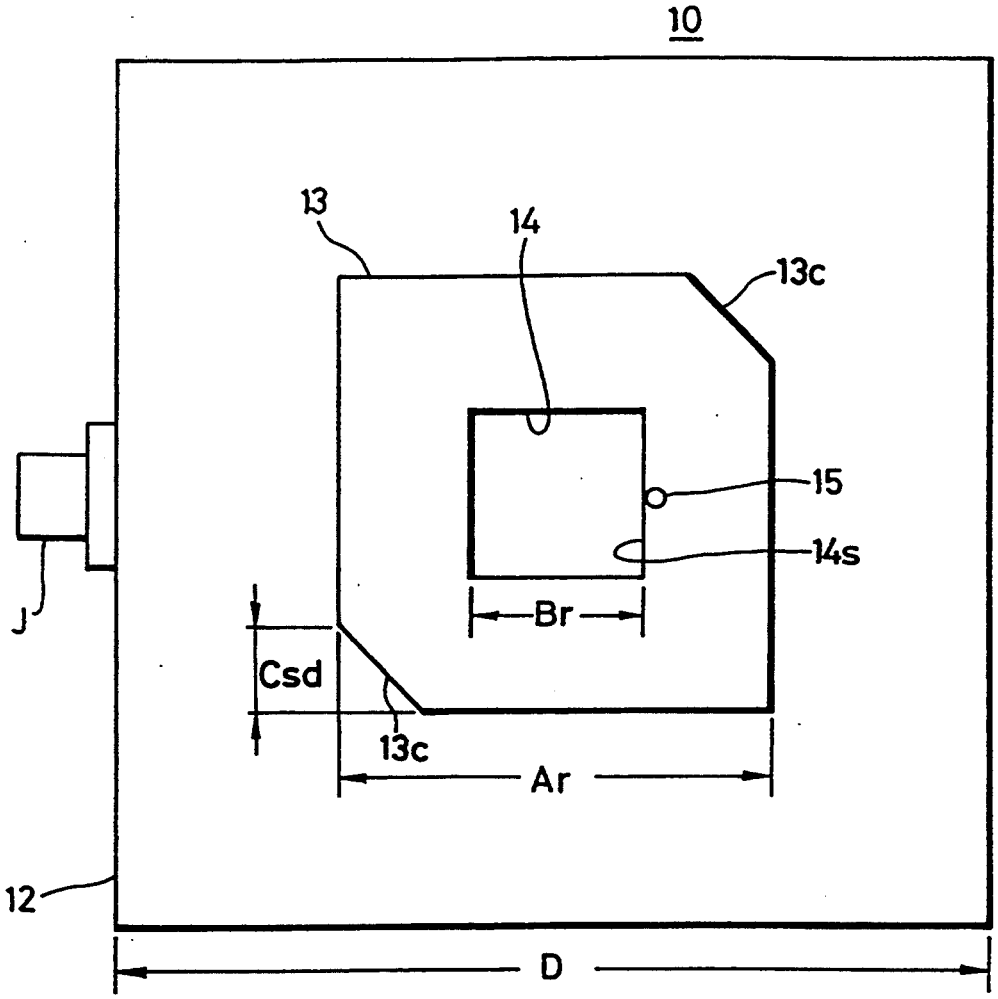
FIG. 20 is a plan view illustrating an arrangement of a planar antenna according to a third embodiment of the present invention.

An arrangement of a third embodiment of the present invention will be described with reference to FIG. 20. In FIG. 20, like parts corresponding to those of FIG. 6 are marked with the same references and therefore need not be described in detail.

Referring to FIG. 20, there is provided the planar antenna 10 in which the rectangular radiation element 13 is concentrically laminated on the rectangular ground conductor 11 through the rectangular dielectric layer 12 made of a low loss material such as the fluorine resin.

A pair of recesses 13*c* are formed along one diagonal line of the radiation element 13 for effecting degeneration and separation and the rectangular opening 14 is concentrically formed through the radiation element 13 so as to provide the ring-shaped radiation element. Also, the feed point 15 is disposed near the center of one side 14*s* of this opening 14. This feed point 15 is coupled to a signal source (not shown) by means of the feed system shown in FIGS. 7 and 8, for example.

Figure 6:
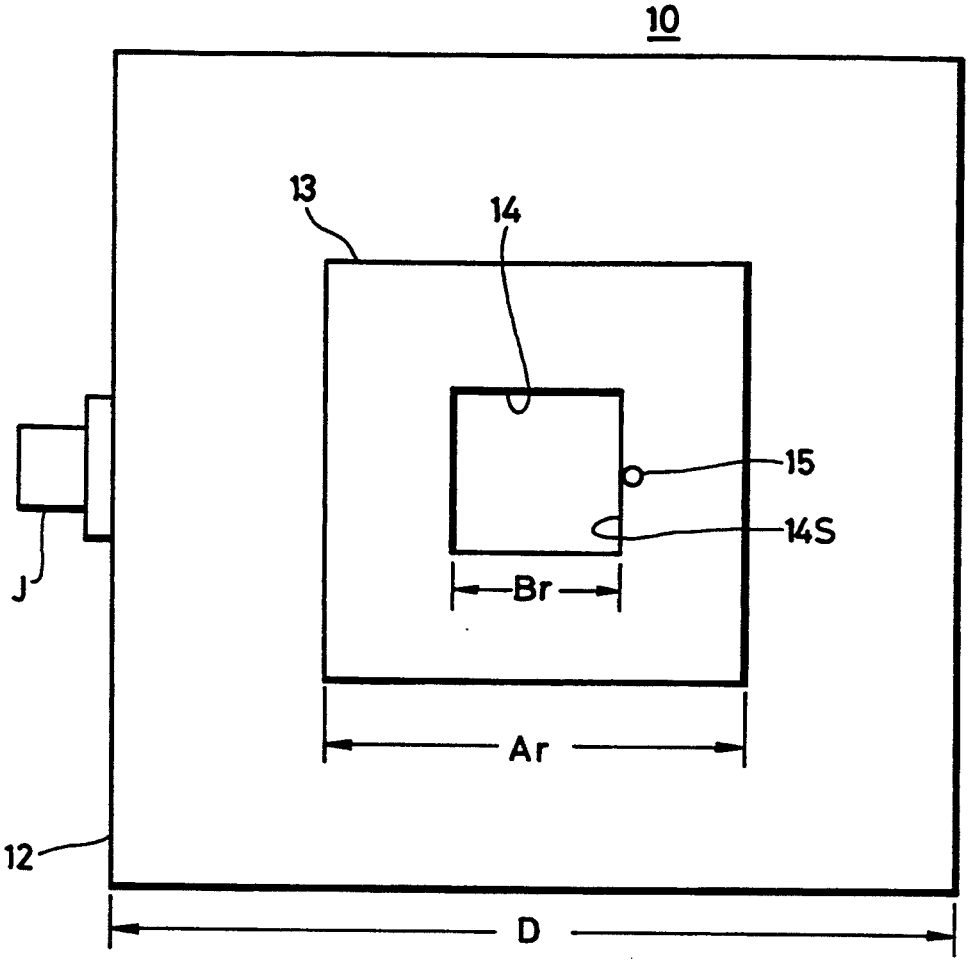
FIG. 6 is a plan view illustrating an arrangement of a planar antenna according to a first embodiment of the present invention.

When the planar antenna 10 according to the third embodiment of the present invention is utilized in the 3 GHz band, for example, the dimensions of the ground conductor 11, the radiation element 13, the rectangular opening 14 and the thickness and dielectric constant of the dielectric layer 12 are set similarly to those of the embodiment shown in FIG. 6.

Further, the no-load Q of the planar antenna 10 and the dimension Csd of the recess 13*c* are set as follows:

Qo=77, Csd=1.7 mm

Figure 21:
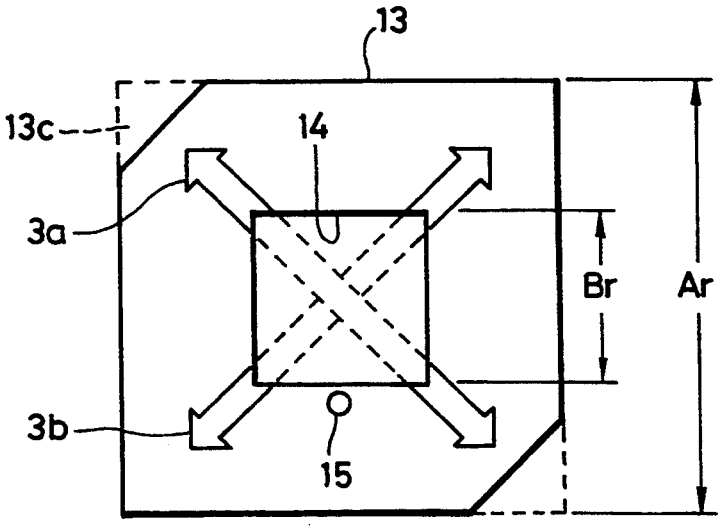
FIG. 21 is a schematic diagram used to explain operation of the third embodiment of the planar antenna according to the present invention.

Operation of the third embodiment according to the present invention will be described with reference to FIG. 21.

In this connection, when the conventional planar antenna having the dielectric layer of the same quality and same thickness as those of the dielectric layer according to the third embodiment and having a ring ratio of 0 is similarly utilized in the 3 GHz band, for example, the side length Ar of the radiation element becomes as mentioned before:

Ar=29.6 mm

This side length (29.6 mm) is larger than the side length of the rectangular ring radiation element 13 according to the third embodiment by about 24%. In the conventional planar antenna, the dimensions of the ground conductor and the dielectric layer are increased with substantially the same ratio.

Further, the no-load Q of the conventional planar antenna 1 of the degeneration and separation type and the dimension Csd of the recess 1*c* as shown in FIG. 1 are respectively set as follows:

Qo=42, Csd=3.2 mm

According to the third embodiment, since the rectangular opening is concentrically formed through the rectangular radiation element having the recesses for effecting the degeneration and separation so as to provide the ring-shaped radiation element and also the single feed point is disposed near the center of one side of the opening, the planar antenna can be miniaturized more and can generate circularly-polarized waves while the satisfactory space factor and the isotropic property of the radiation element can be maintained. Also in this case, characteristics substantially equal to those of FIGS. 13 to 15 can be obtained.

Figure 22:
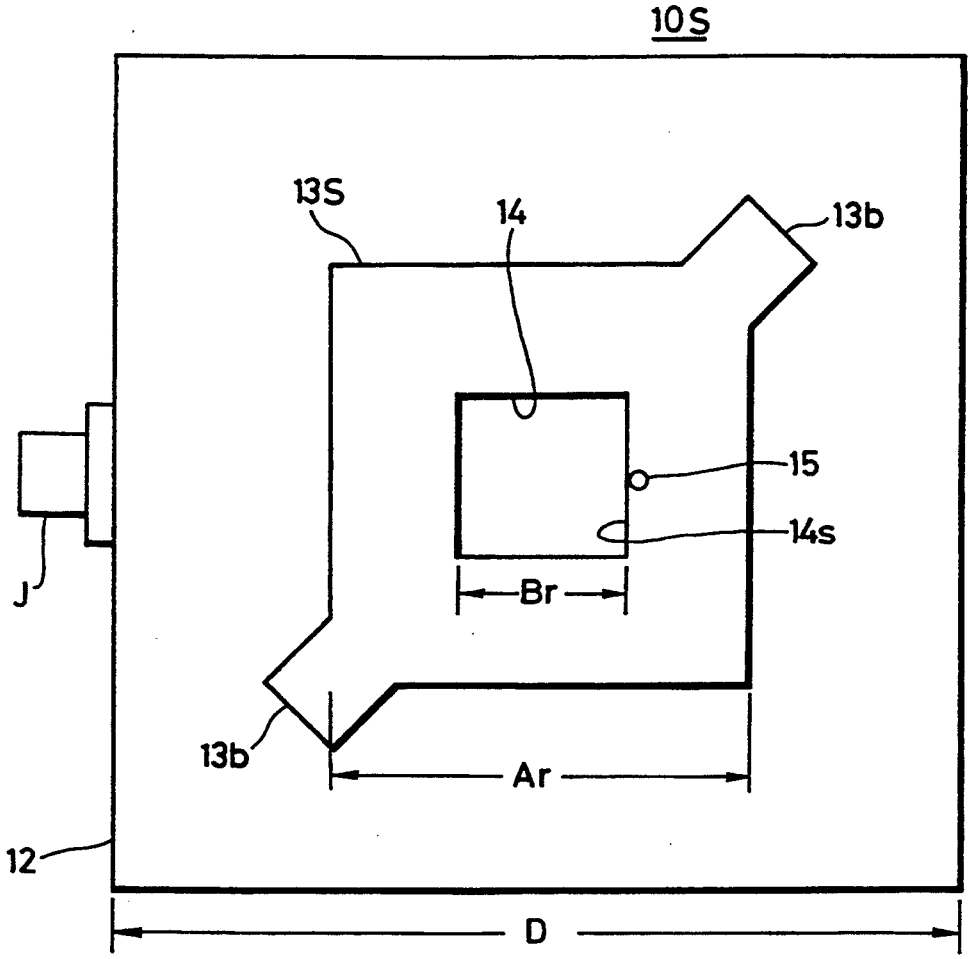
FIG. 22 is a plan view illustrating an arrangement of a planar antenna according to a fourth embodiment of the present invention.

FIG. 22 of the accompanying drawings shows an arrangement of a fourth embodiment of the present invention. In FIG. 22, like parts corresponding to those of FIG. 20 are marked with the same references and therefore need not be described in detail.

As shown in FIG. 22, a planar antenna 10S comprises a rectangular radiation element 13S concentrically disposed on the rectangular ground conductor 11 through the dielectric layer 12 of low loss.

A pair of stubs 13*b* for effecting the aforesaid degeneration and separation are formed along one diagonal line of this radiation element 13S and the rectangular opening 14 is concentrically formed through the radiation element 13S so as to provide the ring-shaped radiation element. Also, the feed point 15 is disposed near the center of one side 14*s* of the opening 14.

The feed point 15 is coupled to a signal source (not shown) by means of the feed system 20 shown in FIGS. 7 and 8.

Operation of the fourth embodiment according to the present invention will be described hereinafter with reference to also FIG. 23.

Figure 23:
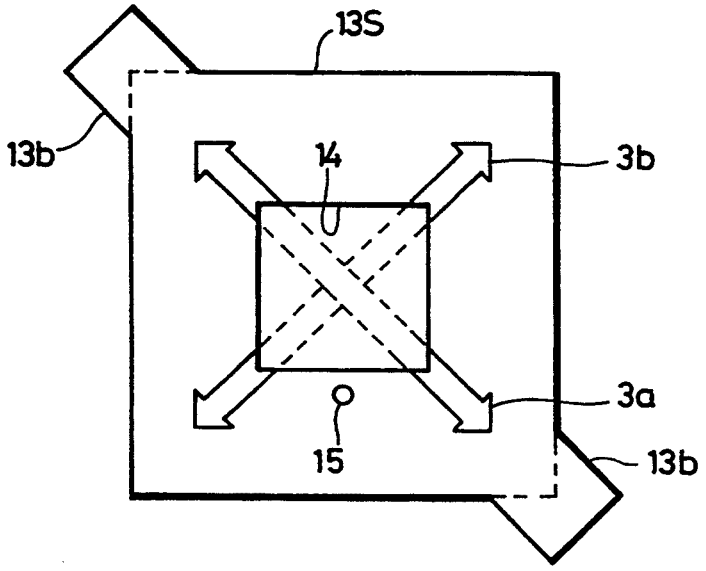
FIG. 23 is a schematic diagram used to explain operation of the fourth embodiment of the planar antenna according to the present invention.

Also in this embodiment, since the radiation element 13S having the stubs 13*b* extended for effecting the degeneration and separation is shaped as the rectangular ring and the isotropic property thereof and the satisfactory space factor are maintained, the phase difference orthogonal excitation by the single feed point 15 becomes possible as shown by the arrows 3*a*, 3*b* in FIG. 23 and this planar array antenna can generate circularly polarized waves.

Further, similar to the aforementioned embodiment, the dimension relative to the same resonance frequency can be reduced in response to the ring ratio of the radiation element 13S.

Also in this case, characteristics substantially equal to those of FIGS. 13 to 15 can be obtained.

Figure 24:
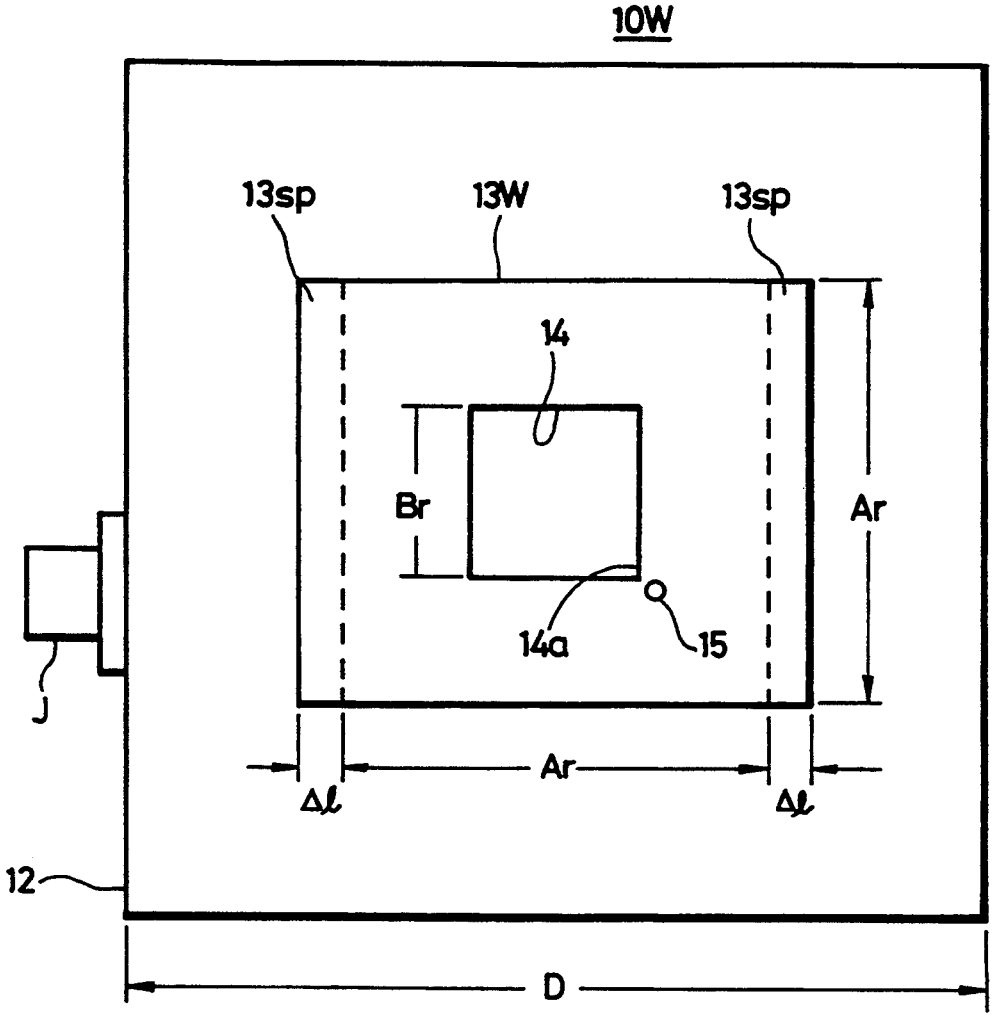
FIG. 24 is a plan view illustrating an arrangement of a planar antenna according to a fifth embodiment of the present invention.

FIG. 24 of the accompanying drawings shows an arrangement of a fifth embodiment according to the present invention. In FIG. 24, like parts corresponding to those of FIG. 20 are marked with the same references.

Referring to FIG. 24, a planar antenna 10W comprises a rectangular radiation element 13W concentrically disposed on the rectangular ground conductor 11 through the low loss dielectric layer 12.

A pair of extended portions 13*sp* for effecting the degeneration and separation are formed on the radiation element 13W along two opposing sides formed on the outer circumference of the radiation element 13W and the rectangular opening 14 is concentrically formed through the radiation element 13W so as to provide the ring-shaped radiation element. The feed point 15 is disposed near a vertex 14*a* of the opening 14.

The feed point 15 is coupled to a signal source (not shown) by means of the feed system 20 shown in FIGS. 7 and 8.

Operation of the fifth embodiment according to the present invention will be described below with reference to also FIG. 25.

Figure 25:
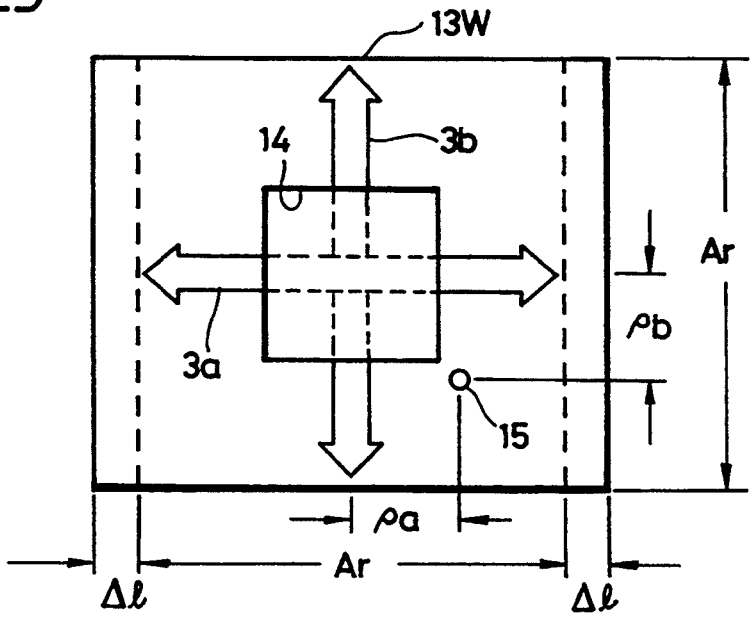
FIG. 25 is a schematic diagram used to explain operation of the fifth embodiment of the planar antenna according to the present invention.

Also in accordance with the present invention, since the radiation element 13W having the extended portion 13*sp* elongated therefrom for effecting the degeneration and separation is shaped as the rectangular ring and the isotropic property thereof and the satisfactory space factor are maintained, as shown by the arrows 3*a*, 3*b* of FIG. 25, the phase difference orthogonal excitation by the single feed point 15 becomes possible so that the planar antenna of the fifth embodiment can generate circularly-polarized waves.

Further, similar to the aforesaid embodiments, the dimension relative to the same resonance frequency can be reduced in response to the ring ratio of the radiation element 13W.

In this case, the input impedance of the planar antenna 10W becomes a sum of input impedances provided in respective modes where the feed point 15 is offset from the center of the radiation element 13W to the excitation directions 3*a*, 3*b* by $\rho a$ and $\rho b$, respectively and becomes higher than the ordinary input impedance.

Also in this case, characteristics substantially equal to those of FIGS. 13 to 15 can be obtained.

As described above in detail, according to the present invention, since the rectangular opening is concentrically formed through the rectangular radiation element which is partly deformed so as to effect the degeneration and separation to thereby provide the ring antenna and the single feed point is disposed near the opening, the planar antenna can generate circularly-polarized waves by the simple feed system and also can be miniaturized more while the satisfactory space factor and the isotropic property of the radiation element are maintained.

Furthermore, a planar array antenna can be constructed by coupling a plurality of planar antennas according to the present invention in array.

Having described the preferred embodiments of the invention with reference to the accompanying drawings, it is to be understood that the invention is not limited to those precise embodiments and that various changes and modifications thereof could be effected by one skilled in the art without departing from the spirit or scope of the invention as defined in the appended claims.

What is claimed is:

1. A planar antenna comprising:

a ground conductor;

a first dielectric layer laminated on one surface of said ground conductor;

a second dielectric layer laminated on a second surface of said ground conductor opposite said first dielectric layer;

a rectangular radiation element laminated on said first dielectric layer on a surface opposite said ground conductor, wherein a rectangular opening is formed through said radiation element at substantially a central area thereof so as to provide a ring-shaped radiation element and feed points are respectively disposed near center portions of two perpendicular sides of said opening, whereby the ratio of the length of one side of the rectangular opening divided by the length of one side of the rectangular radiation element is not greater than 0.6, and wherein said radiation element maintains a substantially isotropic property for generating two independent orthogonal propagation modes at substantially equal resonant frequencies and for producing a circularly polarized wave;

a feed line provided on said second dielectric layer on a surface thereof opposite said ground conductor, wherein said feed line is coupled to said radiation element by way of two through-holes in said radiation element, said ground conductor, and said first and second dielectric layers; and a coaxial connector connected to said feed line, said coaxial connector mounted on the side of said second dielectric layer and aligned axially therewith.

2. A planar antenna comprising:

a ground conductor;

a first dielectric layer laminated on one surface of said ground conductor;

a second dielectric layer laminated on a second surface of said ground conductor opposite said first dielectric layer;

a rectangular radiation element laminated on said first dielectric layer on a surface opposite said ground conductor, wherein a rectangular opening is formed through said radiation element at substantially a central area thereof so as to provide a ring-shaped radiation element further comprising a single feed point disposed near a center of one side of said opening, whereby the ratio of the length of one side of the rectangular opening divided by the length of one side of the rectangular radiation element is not greater than 0.6, and wherein said radiation element maintains a substantially isotropic property for generating two independent orthogonal propagation modes at substantially equal resonant frequencies and for producing a circularly polarized wave;

a feed line provided on said second dielectric layer on a surface thereof opposite said ground conductor, wherein said feed line is coupled to said radiation element by way of a through-hole in said radiation element, said ground conductor, and said first and second dielectric layers; and a coaxial connector connected to said feed line, said coaxial connector mounted on the side of said second dielectric layer and aligned axially therewith.

3. The planar antenna according to claim 2, wherein said radiation element has a pair of triangular recesses formed at both ends of a diagonal line extending from a corner of said radiation element to an opposite corner thereof and said feed point is disposed near a center of one side of said opening.

4. The planar antenna according to claim 2, wherein said radiation element has a pair of rectangular stubs formed at both ends of a diagonal line extending from a corner of said radiation element to an opposite corner thereof and said feed point is disposed near a center of one side of said opening.

5. The planar antenna according to claim 2, wherein said radiation element has a pair of extended portions formed along opposing two sides of an outer perimeter and said feed point is disposed near a vertex of said opening.

6. The planar antenna according to claim 2, wherein said feed line includes a stub.

7. The planar antenna according to claim 2, wherein said feed point is disposed near a center of one side of said opening.

* * * * *